US006698927B2

(12) United States Patent
Hedaya et al.

(10) Patent No.: US 6,698,927 B2
(45) Date of Patent: Mar. 2, 2004

(54) BAG STUFFER WITH IMPROVED SPRING

(75) Inventors: Maurice Hedaya, Brooklyn, NY (US); Kenneth James Kelly, Long Valley, NJ (US); Alfred Powell Kelly, Branchville, NJ (US); Tom Aloysius Kelly, Blairstown, NJ (US)

(73) Assignee: Barclay Brown, Brooklyn, NY (US)

( * ) Notice: Subject to any disclaimer, the term of this patent is extended or adjusted under 35 U.S.C. 154(b) by 0 days.

(21) Appl. No.: 10/098,958

(22) Filed: Mar. 15, 2002

(65) Prior Publication Data

US 2003/0174908 A1 Sep. 18, 2003

(51) Int. Cl.[7] ..... B65D 30/00
(52) U.S. Cl. ..... 383/127; 383/35
(58) Field of Search ..... 383/127, 33, 34, 383/34.1, 35; 190/106

(56) References Cited

U.S. PATENT DOCUMENTS 2,640,520 A * 6/1953 Miller et al. ..... 190/106
2,730,153 A * 1/1956 Miller et al. ..... 190/106
2,783,808 A * 3/1957 Renz et al. ..... 190/106
2,795,259 A * 6/1957 Nash ..... 150/152
2,819,749 A * 1/1958 Renz et al. ..... 190/106
5,259,674 A * 11/1993 Hedaya et al. ..... 383/127
5,758,974 A * 6/1998 Markowitz ..... 383/127

* cited by examiner

*Primary Examiner*—Jes F. Pascua
(74) *Attorney, Agent, or Firm*—Notaro & Michalos P.C.

(57) ABSTRACT

A bag stuffer for an expandable bag has an insert movable from a collapsed to an expanded orientation and made of at least one substantially rigid and substantially planar side panel and a bottom panel. The side panel is connected to one end of the bottom panel at a hinge containing a fold between the side panel and the bottom panel and a Z shaped torsion spring biases the insert toward the expanded orientation. The spring has a torso disposed only at the hinge for directly acting on the fold to bias the side panel away from the bottom panel and toward the expanded orientation, and a pair of arms extending at angles from opposite ends of the torso, each arm lying flat against an inside surface of the respective bottom panel and side panel.

20 Claims, 2 Drawing Sheets

BAG STUFFER WITH IMPROVED SPRING

FIELD AND BACKGROUND OF THE INVENTION

The present invention relates generally to bag stuffers having an insert movable from a collapsed orientation which enables compact storage of an expandable bag containing the insert, to an expanded orientation which provides a commercial display of the expandable bag containing the insert, and in particular to such a bag stuffer with an improved spring.

Bag stuffers or expanders are well-known in the retail art. Each includes an insert movable from a collapsed orientation which enables compact storage, to an expanded orientation which provides a commercial display of the expandable bag containing the insert. Bag stuffers are used with a wide variety of expandable articles which, for reasons of economy, are preferably shipped and stored in a relatively flat or collapsed orientation, but are best presented in commercial displays in an expanded orientation. Such articles include backpacks, baseball bags, basketball bags, beach bags, belt bags, briefcases, cooler bags, cosmetic kits, cross trainer bags, duffle bags, Dop kits, bowling bags, fashion totes, hand bags, locker bags, lunch bags, pilot cases, purses, roller skating bags, snorkeling bags, soft-sided luggage, sports bags, sportsman's gear bags, tackle bags, tennis bags, utility bags and the like. The present invention can be used to stuff any of these bags and any other soft bags not specifically listed, as well.

Initially the function of the bag stuffer was performed by cardboard forms or crushed paper which had to be inserted by the retailer after receipt of the collapsed article from the manufacturer. Indeed, some bag stuffers still require the retailer to insert his hand or an instrument into the collapsed article to activate the bag stuffer, that is, to move the insert from its collapsed orientation to its expanded orientation. Modern bag stuffers, however, typically include means for biasing the insert to the expanded orientation, and releasable restraining means which are disposed about the insert in the collapsed orientation for restraining movement of the insert from the collapsed orientation to the expanded orientation.

In its simplest form, the restraining means may be disposed about the outside of the expandable bag containing the insert so that the retailer has only to cut or otherwise disable the restraining means in order to activate the insert. This is generally not an acceptable situation as the restraining means (or the article used to cut or disable the restraining means) may mar the exterior surface of the bag, thereby rendering it unsaleable. Accordingly, most modern restraining means are disposed about the insert and within the expandable bag containing the insert, so that the restraining means cannot mar the exterior surface of the bag.

A further disadvantage of the known bag stuffers is the requirement that the ends of the biasing means (which is typically a coil spring) must be secured to the planar elements or panels of the insert against which they bear by adhesive or the like. The use of adhesive is typically messy and time consuming (as the adhesive must be given an opportunity to dry before it is subjected to forces which may result in relative movement of the spring and the panel), and therefore expensive. While non-adhesive techniques exist for securing the spring ends and planar elements of the insert together, these typically involve expensive and/or compound mechanisms. Accordingly, the need remains for a bag stuffer wherein the ends of the biasing means are directly secured to the planar elements without adhesives and without expensive and/or compound mechanisms.

A further disadvantage of the known bag stuffers is the limitations on the configurations of the expandable bags with which they are useful. Thus while the known bag stuffers are typically useful with relatively shallow, generally rectangular bags, the various planar elements of the insert which abut the bag and are used to force the bag to its expanded orientation could not be used in connection with cylindrical or duffel-type bags or other bags not having parallel sides. Additionally, even where the bag has parallel sides, the biasing means typically cannot separate the planar elements by more than a given distance (determined by the length of the coil spring biasing means) unless an intermediate panel or flap is used (with the biasing means acting on the flap which in turn separates the planar elements). Accordingly, the need remains for a bag stuffer which can expand unusually shaped bags and which, without the presence of intermediate elements (such as flaps) permits the biasing means to move the planar elements abutting the bag to a desired separation greater than the length of the biasing means.

One of the inventors of the present application (Hedaya) has contributed to this field in U.S. Pat. Nos. 5,542,767 and 5,259,674, as well as U.S. patent application Ser. No. 09/768,882 filed Jan. 24, 2001 for an Improved Bag Stuffer, which are all incorporated here by reference. Both patents disclose the use of springs to deploy panels of a bag expander or stuffer. The pending U.S. patent application discloses improved designs and placement for the springs.

A need still remains for a bag stuffer of increased efficience and reduced cost and complexity for the luggage industry and related fields.

SUMMARY OF THE INVENTION

It is an object of the present invention to provide a bag stuffer which is safe to use, simple and inexpensive to manufacture and deploy.

Another object is to provide a bag stuffer where the ends of the biasing means can be directly secured to the insert planar elements without adhesives and without expensive and/or compound mechanisms.

A further object is to provide a bag stuffer which permits the biasing means to move the planar elements abutting the bag to a desired separation greater than the length of the biasing means without the presence of intermediate elements such as flaps.

It is also an object of the present invention to provide a bag stuffer which, in one embodiment, is useful with non-rectangular bags.

It has been found that the above and related objects of the present invention are obtained in a bag stuffer for an expandable bag, the stuffer having a floor panel and one or two side panels connected at one of two hinges to one end or to both opposite ends of the floor panel. The panels form insert means and biasing means in the form of a uniquely shaped and placed spring is provided at each hinge.

The insert means are movable from a collapsed orientation with the side panel(s) laying flat on and over the floor panel, for enabling compact storage of an expandable bag containing the insert means, to an expanded orientation with the side panel pushed up and away from the floor panel, for providing a commercial display of an expanded bag containing the insert means.

According to the preferred embodiment of the present invention, the spring is shaped like the letter Z and utilizes a torsional twisting of the middle, body or torso portion of the Z to bias the side panel(s) toward its outward or open position.

The panels are substantially rigid, substantially planar elements that are connected to each other at the hinges.

The springs are each Z shaped torsion springs with straight torso or body portions and straight or bent arms extending at angles from opposite ends of the torso portion. The arms respectively lie flap against an inside surfaces of the floor and side panels. The torso portion is held outside the hinge or hinge area of the insert which is simply a fold line in the insert material between the panels. The straight middle or torso portion extends through a pair of spaced openings in the insert at the hinge or fold line to hold the spring in place in the simplest, cheapest yet most effective manner. This simply and efficiently locks the springs in place without glue or other structures, and caused the springs to act immediately at the hinge area on the fold lines to open the side panels. This local action of all the torsional spring force of the invention immediately in the hinge areas, among other things, distinguishes the present invention over the prior art.

Where corrugated cardboard is used as the panel material, the corrugations extend parallel to the serial connection of the panels to each other. This is also transverse to the fold lines forming the hinge areas between the panels. The arms or ends of each Z shaped spring lie flat against the inner surfaces of the cardboard and have a strong, wear-resistant area against which to apply the spring force to open the panels without damaging the cardboard material or exposing the tips of the spring.

Although certain preferred embodiments of the invention include a bottom panel and a pair of opposite side panels which are either folded to the same side of the bottom panel or to opposite sides of the bottom panel to form a Z shape for the insert as well, the invention operates just as well for certain types of bags with a bottom panel and only a single side panel to form an L shaped insert.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
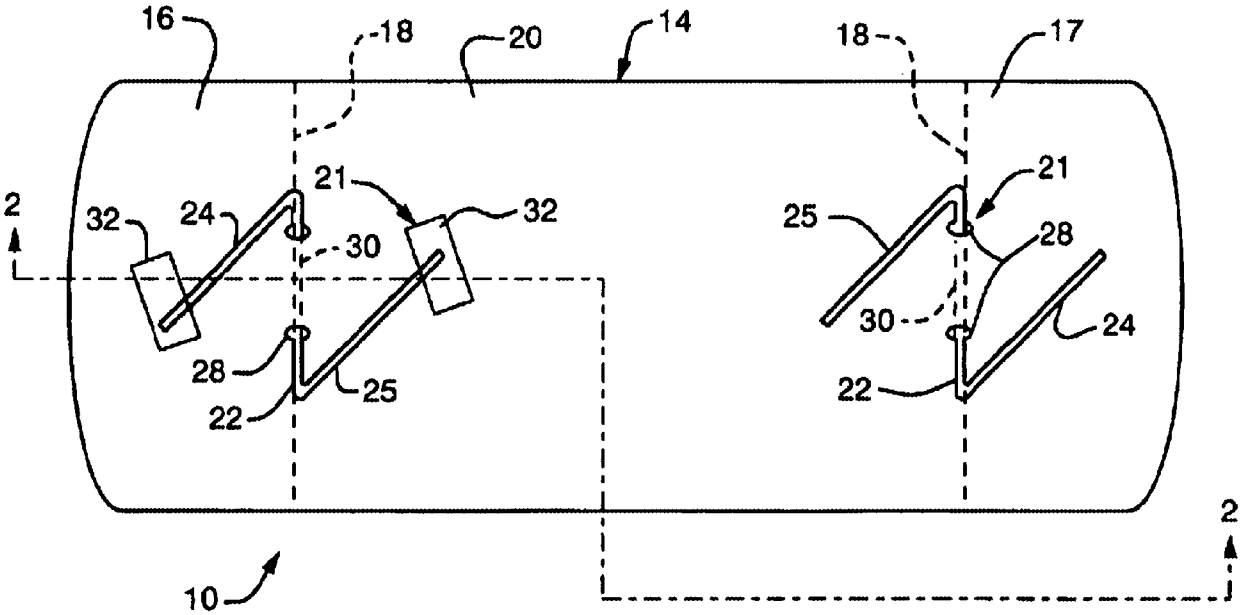
FIG. 1 is a top plan view of one embodiment of the bag stuffer of the invention, in an open flat position before insertion into a bag to be stuffed.
Figure 2:
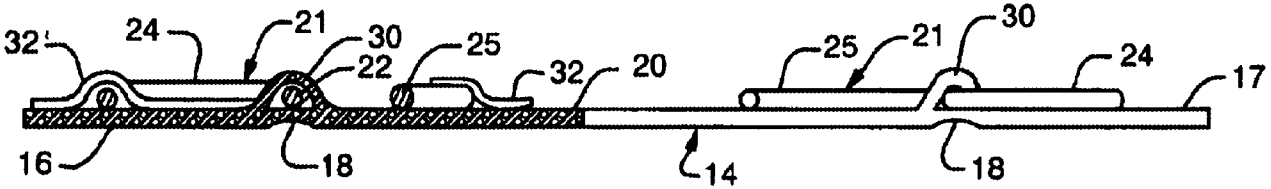
FIG. 2 is a side sectional view taken along line 2—2 of FIG. 1.

Referring to the drawings, the invention embodied in FIGS. 1 and 2 is a bag stuffer generally designated 10 in an open flat orientation or position before it is inserted into an expandable bag. The expandable bag, shown schematically at 12 in FIGS. 3 and 4, may be soft-sided luggage, a purse, a cosmetic kit, a Dop kit, a briefcase, a backpack or any other type of soft bag. Its is not necessarily a rectangular right angled parallelepiped or box-like configuration. The bag may be of cylindrical, trapezoidal, irregular or of any other configuration.

Figure 3:
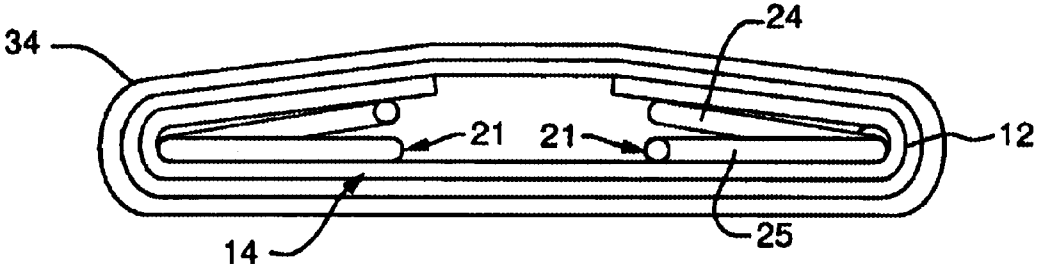
FIG. 3 is a side elevational view of the bag stuffer of FIG. 2, in a folded position inside a collapsed bag that is vacuum sealed in a wrapper for storage and shipment.

It will be appreciated by those familiar with the bag stuffer art that the soft portions of the bag 12 which can be folded down to a collapsed position for storage and transport, are typically randomly crumpled and not folded in a neat and orderly manner as shown in FIG. 3, for example. For the present invention it is sufficient for the bag to have an area inside, usually at the bottom of the bag, which can receive the bag stuffer of the present invention in its collapsed or closed orientation shown in FIG. 3.

Returning to FIGS. 1 and 2, the bag stuffer 10 comprises an insert or insert means, generally designated 14, movable from a collapsed orientation (FIG. 3) enabling compact storage and shipping of the expandable bag 12 containing the insert 14 and to an expanded orientation (FIG. 4) providing a commercial display of the expandable bag 12 containing the insert 14 expanded.

In FIG. 1, the insert comprises a pair of substantially planar, substantially rigid end elements or panels 16 and 17, which are connected at hinges or hinge areas 18, 18, to the opposite ends of a base element or bottom panel 20. The end panels are shaped to correspond generally to the sides of the bag to be stuffed.

The panels 16, 17 and 20 are preferably formed of one or more sheets of paperboard, e.g. corrugated cardboard like, having edges that are softer than the interior surface of the bag 12 so that they do not mar or damage the bag.

The bag stuffer 10 additionally includes biasing means positioned immediately at each hinge or hinge area 18, 18, for biasing the insert 14, and in particular the planar elements 16 and 17, from their collapsed orientation where the side element 16, 17 lie flat down on top of and parallel to the top surface of bottom panel 20, like the position shown in FIG. 3, to the expanded orientation illustrated in FIG. 1.

As illustrated in FIGS. 1 and 2 biasing means in the form of a Z shaped spring 21 is provided at each hinge 18 of insert 14. Each spring 21 biases one of the side panels 16, 17 upwardly and outwardly with respect to the bottom panel 20, toward the expanded position of FIG. 4.

Each biasing spring 21 is a torsion spring having a middle, body or torso portion 22 with a pair of opposite ends, and an arm 24 and 25, extending at an angle $\phi$ from each of the opposite ends. The biasing force is substantially contributed by twisting or torsion of torso 21 and all of this force is exerted exactly at the hinges 18 for opening the side panels 16, 17.

Arms 24 and 25 may be straight or bent but each must lie flat against the inner surface of the bottom or side panel 16, 17 and 20. The torso 22 of each spring 21 is held at the hinge 18 by passing through a pair of hole, slits or openings 28, 28, cut at or transversely across the hinge 18. This creates a raised retaining portion of cardboard material 30 extending over part of torso 22 to hold the spring to the hinge regardless of the angular position of the side panels 16,17 with respect to the bottom panel 20. The spring is easily inserted by a free end of one of the arms 24 or 25, into one of the holes 28, slide across the hinge 18 and passed into the other hole 28 to bring the torso 22 parallel to the hinge 18 under the material 30, and to place the arms 24 and 25 against the inner surfaces of the panels 16 and 17.

Although no structure is needed to keep the arms 24, 25 flat against the inside surfaces of the insert, tape 32 may be used over the arms and, in particular over the ends of the arms, to protect the ends. Alternatively the ends can pass through additional slots or holes in the panels (not shown). It is best, however, that all parts of the springs remain at inside surfaces of the insert 14 to protect the bag 12 against any damage due to the hard, tempered steel springs 21.

Wire that is bent to form the springs may be about 2.5 mm in diameter, or within the range of about 1 to 5 mm in diameter and made of tempered spring steel or other appropriate steel of non-steel material with good resiliency.

FIG. 3 illustrates the stuffer collapses into a collapsed bag 12 that is also closely wrapped, e.g. vacuum wrapped, by plastic 34. This keeps the stuffer collapsed against the opening bias of springs 21.

Figure 4:
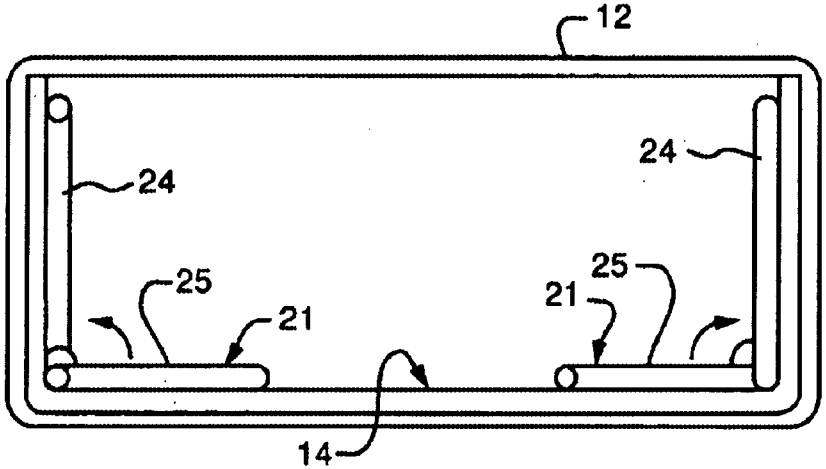
FIG. 4 is a view similar to FIG. 3 but of the stuffer of the invention in an expanded position inside the expanded bag for display.

FIG. 4 illustrates the expanded bag 12, after wrapping 34 has been removed and the bag shaken to open cause Z shaped springs to push side panels 16 and 17 up and way from bottom panel 20. This happens quickly and spontaneously due to the flexible nature of the bag.

Figure 5:
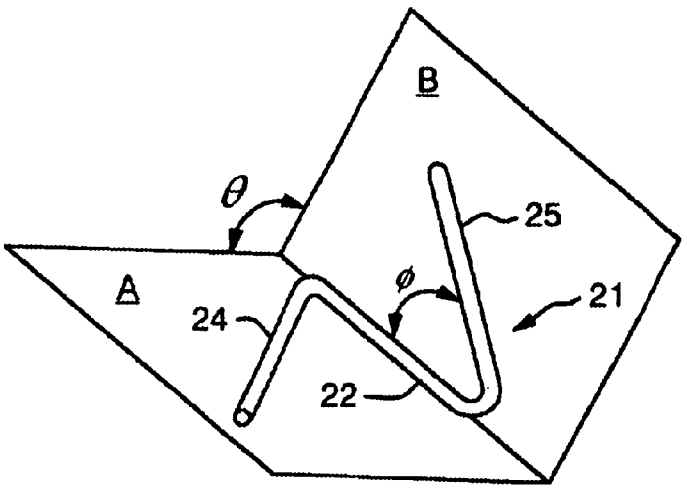
FIG. 5 is a view of the torsion spring of the invention superimposed on a pair of intersecting planes to better illustrate the shape of the spring.

FIG. 5 illustrate the pre-bent positions of arms 24 and 25 on torso 22 of the spring 21. Each arm is bent at an angle $\phi$ of about 60° or within the range of about 20° to 110° (preferably 40° to 80°) to the torso 22. Each arm 24 also lies in a first plane A with the torso 22 that is at an angle $\theta$ of about 40° or within the range of about 10° to 270° (preferably 20° to 100°) to a second plane B containing the other arm 25 and torso 22. This helps increase or decrease the torsional force exerted by each spring when it bent into the collapsed position of FIG. 3.

While a specific embodiment of the invention has been shown and described in detail to illustrate the application of the principles of the invention, it will be understood that the invention may be embodied otherwise without departing from such principles.

What is claimed is:

1. A bag stuffer for an expandable bag, the bag stuffer comprising:

an insert movable from a collapsed orientation for enabling compact storage of an expandable bag containing said insert, to an expanded orientation for providing a commercial display of an expandable bag containing said insert, said insert comprising at least one substantially rigid and substantially planar side panel and a bottom panel, said side panel being connected to one end of said bottom panel at a hinge containing a fold between the side panel and the bottom panel said insert having a pair of slits at the hinge; and a Z shaped torsion spring for biasing said insert toward said expanded orientation, said spring having a torso disposed only at said hinge for directly acting on said fold to bias said side panel away from the bottom panel and toward the expanded orientation, and a pair of arms extending at angles from opposite ends of the torso, each arm lying flat against an inside surface of the respective bottom panel and side panel the torso extending through the slits for holding the spring at the hinge.

2. The stuffer of claim 1, wherein each of said angles is about 20° to 110°.

3. The stuffer of claim 2, wherein each of said angles is about 40° to 80°.

4. The stuffer of claim 1, wherein each arm lies in a first plane with the torso that is at a second angle to a second plane containing the other arm and torso.

5. The stuffer of claim 4, wherein the second angle is about 10° to 270°.

6. The stuffer of claim 5, wherein the second angle is about 20° to 100°.

7. The stuffer of claim 1, wherein said spring is a bent and tempered steel wire.

8. The stuffer of claim 7, wherein said wire has a diameter of about 1 to 5 mm.

9. The stuffer of claim 1, wherein the insert is made of cardboard and the hinge is a fold in the cardboard.

10. The stuffer of claim 1, wherein the insert includes a second side panel connected at a second hinge to the bottom panel opposite from the first-mentioned side panel and a Z shaped torsion spring at the second hinge.

11. A bag stuffer for an expandable bag, the bag stuffer comprising:

an insert movable from a collapsed orientation for enabling compact storage of an expandable bag containing said insert, to an expanded orientation for providing a commercial display of an expandable bag containing said insert, said insert comprising at least one substantially rigid and substantially planar side panel and a bottom panel, said side panel being connected to one end of said bottom panel at a hinge containing a fold between the side panel and the bottom panel; and a Z shaped torsion spring for biasing said insert toward said expanded orientation, said spring having a torso disposed only at said hinge for directly acting on said fold to bias said side panel away from the bottom panel and toward the expanded orientation, and a pair of arms extending at angles from opposite ends of the torso, each arm lying flat against an inside surface of the respective bottom panel and side panel, wherein each of said angles is about 40° to 80° .

12. The stuffer of claim 11, wherein said spring is a bent and tempered steel wire.

13. The stuffer of claim 12, wherein said wire has a diameter of about 1 to 5 mm.

14. The stuffer of claim 11, wherein the insert is made of cardboard and the hinge is a fold in the cardboard.

15. The stuffer of claim 11, wherein the insert includes a second side panel connected at a second hinge to the bottom panel opposite from the first-mentioned side panel and a Z shaped torsion spring at the second hinge.

16. A bag stuffer for an expandable bag, the bag stuffer comprising:

an insert movable from a collapsed orientation for enabling compact storage of an expandable bag containing said insert, to an expanded orientation for providing a commercial display of an expandable bag containing said insert, said insert comprising at least one substantially rigid and substantially planar side panel and a bottom panel, said side panel being connected to one end of said bottom panel at a hinge containing a fold between the side panel and the bottom panel; and a Z shaped torsion spring for biasing said insert toward said expanded orientation, said spring having a torso disposed only at said hinge for directly acting on said fold to bias said side panel away from the bottom panel and toward the expanded orientation, and a pair of arms extending at angles from opposite ends of the torso, each arm tying flat against an inside surface of the respective bottom panel and side panel, each arm laying in a first plane with the torso that is at a second angle of about 10° to 270° with a second plane containing the other arm and torso.

17. The stuffer of claim 16, wherein the second angle is about 20° to 100°.

18. The stuffer of claim 16, wherein said spring is a bent and tempered steel wire.

19. The stuffer of claim 16, wherein the insert is made of cardboard and the hinge is a fold in the cardboard.

20. The stuffer of claim 16, wherein the insert includes a second side panel connected at a second hinge to the bottom panel opposite from the first-mentioned side panel and a Z shaped torsion spring at the second hinge.

* * * * *